United States Patent [19]

Boulanger

[11] 4,005,293

[45] Jan. 25, 1977

[54] PUSHBUTTON KEYBOARD SWITCH ASSEMBLY HAVING INDIVIDUAL CONCAVE-CONVEX CONTACTS INTEGRALLY ATTACHED TO CONDUCTOR STRIPS

[75] Inventor: Henry J. Boulanger, Cumberland, R.I.

[73] Assignee: Texas Instruments Incorporated, Dallas, Tex.

[22] Filed: Nov. 29, 1974

[21] Appl. No.: 528,180

[52] U.S. Cl. ..... 200/5 A; 200/67 DB; 200/159 B; 200/275

[51] Int. Cl.[2] ..... H01H 13/70; H01H 1/06

[58] Field of Search ..... 200/1 R, 5 R, 5 A, 8 CR, 200/159 B, 275, 276, 67 DB

[56] References Cited

UNITED STATES PATENTS

| | | | |
|---|---|---|---|
| 2,966,570 | 12/1960 | Jordan | 200/275 X |
| 3,133,170 | 5/1964 | Nanninga | 200/159 B X |
| 3,571,542 | 3/1971 | Madden et al. | 200/83 N |
| 3,600,528 | 8/1971 | Leposavic | 200/159 B X |
| 3,643,041 | 2/1972 | Jackson | 200/5 A |
| 3,684,842 | 8/1972 | Boulanger | 200/159 B X |
| 3,697,711 | 10/1972 | Tetrick | 200/67 DB |
| 3,742,157 | 6/1973 | Leposavic | 200/159 B X |
| 3,743,798 | 7/1973 | Pentecost | 200/5 R |
| 3,777,082 | 12/1973 | Hatley et al. | 200/5 A |
| 3,786,205 | 1/1974 | Lien | 200/5 A |
| 3,800,104 | 3/1974 | Lien et al. | 200/5 A |
| 3,819,882 | 6/1974 | Anderson et al. | 200/5 A X |
| 3,860,771 | 1/1975 | Lynn et al. | 200/5 R X |
| 3,879,586 | 4/1975 | DuRocher et al. | 200/159 B X |
| 3,886,335 | 5/1975 | Hendricks | 200/1 R |

*Primary Examiner*—James R. Scott
*Attorney, Agent, or Firm*—John A. Haug; James P. McAndrews

[57] ABSTRACT

A pushbutton keyboard system comprising an electrically insulative substrate, a plurality of actuating elements or disks arranged in an array of columns and rows on one face of the substrate, and a plurality of conductors on this one face of the substrate with the conductors being parallel to one another and extending in the direction of the columns.

17 Claims, 10 Drawing Figures

FIG. 7
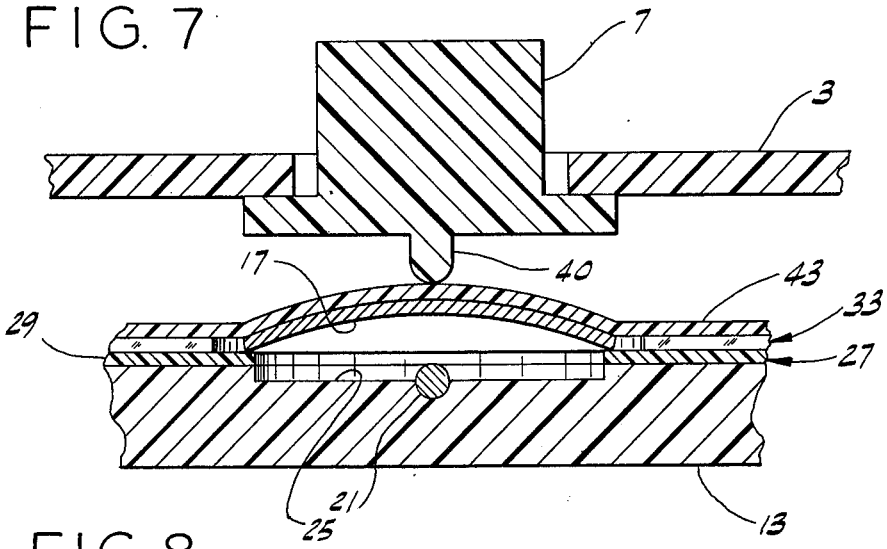
FIG. 8
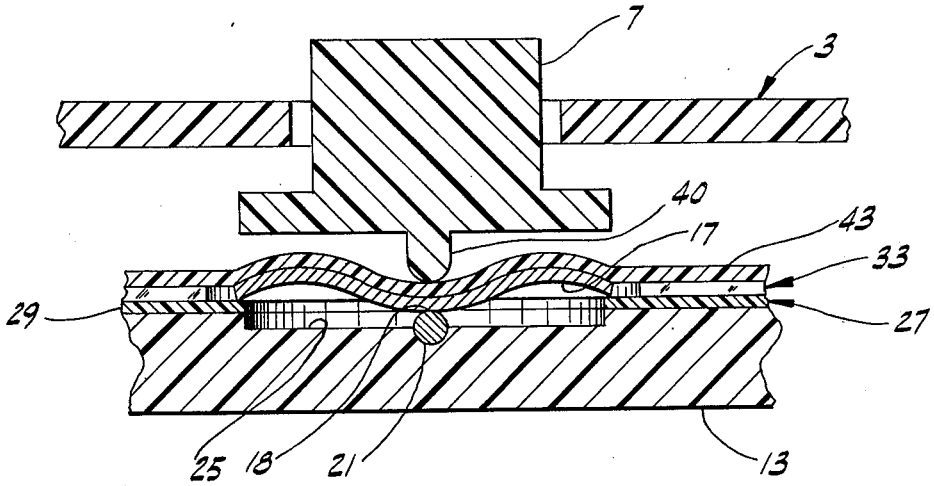
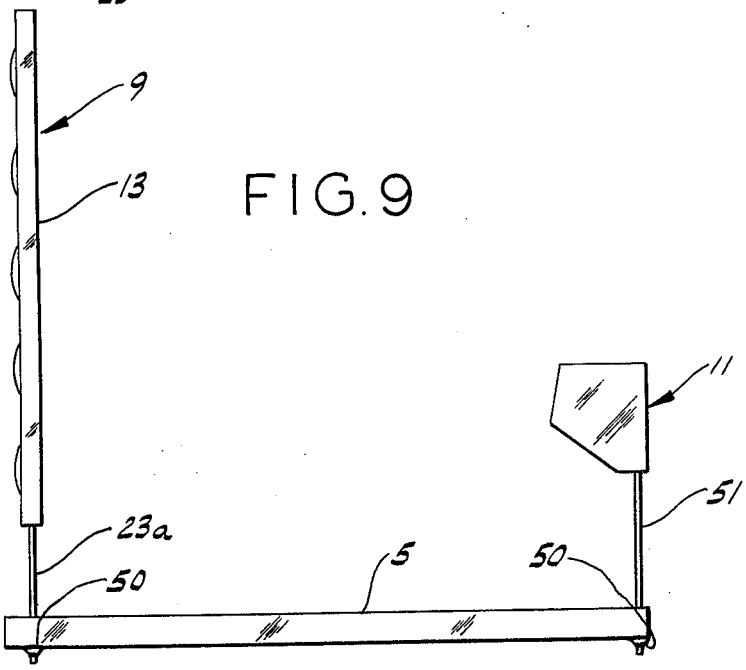
FIG. 9

PUSHBUTTON KEYBOARD SWITCH ASSEMBLY HAVING INDIVIDUAL CONCAVE-CONVEX CONTACTS INTEGRALLY ATTACHED TO CONDUCTOR STRIPS

BACKGROUND OF THE INVENTION

This invention relates to keyboard systems and more particularly to pushbutton keyboard systems for use in electronic pocket calculators, telephones or the like.

In conventional pocket calculators, data (e.g., numbers and arithmetic operations) are usually entered by depressing specified keys which close simple single pole, single-throw (SPST) momentary switches. The physical arrangement of the keys on the keyboard is generally an X-Y matrix (i.e., an array of perpendicular columns and rows). Upon depressing a selected key, an unique signal is generated. For example, the columns in the array of keys may be designated KN, KO, KP and KQ and the rows of keys may be designated D1, D2, . . . D11 so that, for example, upon depressing the key in column KN and in row D1, a signal corresponding to the numeral 1 is supplied to the calculator.

While the physical arrangement of many known prior art keyboards may be arranged in an orderly X-Y matrix, the electrical conductor paths of the keyboard generally have not followed this orderly arrangement. Oftentimes, the type of switches used in keyboards has required there to be several conductive paths to each switch thus necessitating that relatively complicated and complex conductor patterns be imprinted on a printed circuit board or the like. In other known prior art keyboards, a generally rectangular X-Y conductor matrix has been employed, but the conductors crossed one another in a grid pattern and exited the keyboard both at the top and at one side thereof thus requiring additional connector or umbilical wires to be attached to the conductors before the keyboard could be connected to a mother board or electronic logic components. The connection of these connector wires to the conductors is time consuming and expensive.

Reference may be made to the following co-assigned U.S. patents which are believed to be representative of the present keyboard state of the art: U.S. Pat. Nos. 3,684,842, 3,806,673, and 3,808,384.

SUMMARY OF THE INVENTION

Among the many objects of this invention may be noted the provision of a keyboard system which has a minimal number of conductor paths; the provision of such a keyboard system in which preformed conductors may be rapidly and inexpensively applied to a substrate base thus eliminating the requirement of a printed circuit board; the provision of such a keyboard system in which each switch need only make contact with a single conductor to generate a signal; the provision of such a keyboard system which may be more simply and inexpensively connected to a mother board or other electronic components and with a minimal and more efficient arrangement of interconnecting or umbilical wires; the provision of such a keyboard system in which a plurality of switching elements may be assembled in the keyboard as a unit; the provision of such a keyboard system which requires no soldering during assembly thus permitting the keyboard substrate to be of a relatively low cost thermoplastic resin; and the provision of such a keyboard which is readily incorporated in a calculator or other electronic apparatus, which is economical in cost, and which is reliable in operation. Other objects and features will be in part apparent and in part pointed out hereinafter.

Briefly, a pushbutton keyboard system comprises an electrically insulative substrate, a plurality of actuating elements arranged in an array of columns and rows on one face of the substrate, and a plurality of conductors on this face of the substrate. The conductors are parallel to one another and extend in the direction of said columns. There is one conductor for each row of elements and another conductor for each column of elements. Each column conductor is disposed between the substrate and the elements of its respective column. Each of the elements is of a flexible electrically conductive material and has an initial position in which it is clear of its respective column conductor. Further, each of the elements is resiliently deformable from its initial position to an actuated position in which at least one point of the element is in contact with its respective column conductor. Means is provided for electrically connecting the elements in each row to their respective row conductor, whereby, upon moving any one of the elements to its actuated position, a circuit is completed between the column conductor and the row conductor of the actuated element.

BRIEF DESCRIPTION OF THE DRAWINGS

FIG. 7 is an enlarged cross sectional view of a portion of the keyboard system illustrated in FIGS. 2–4 showing a domed switch actuating element in its initial convex position in which it is clear of its respective conductor therebelow with the thickness of certain parts exaggerated for clarity;

FIG. 8 is a view similar to FIG. 7 illustrating the switch element in its overcentered actuated position;

FIG. 9 illustrates a keyboard of this invention and a display module connected to the mother board of the calculator or the like preparatory to being simultaneously soldered to the mother board.

Corresponding reference characters indicate corresponding parts throughout the several views of the drawings.

DESCRIPTION OF PREFERRED EMBODIMENTS

Figure 1:
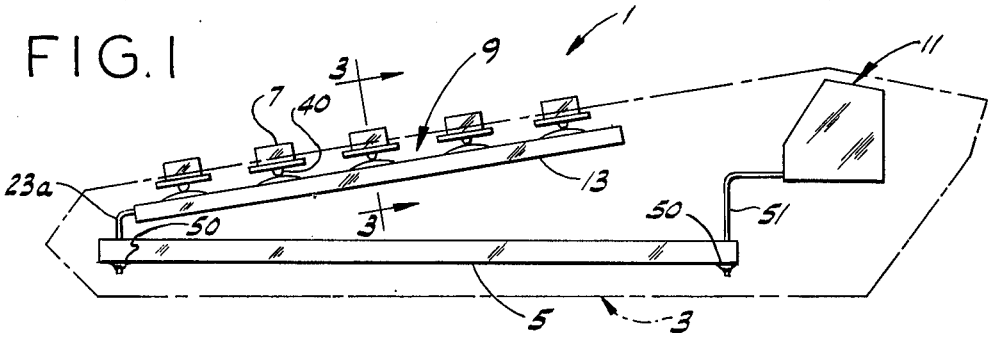
FIG. 1 is a side elevational view of a pocket calculator in which the major components of the calculator including its case, its display module, and its motherboard carrying various electronic logic components (not shown) are illustrated and in which a keyboard system of this invention is installed within the calculator case.

Referring now to the drawings, a pocket calculator, indicated in its entirety at 1, is shown to comprise a case 3 (shown in phantom) of molded synthetic resin or the like in which various electrical apparatus or electronic components (e.g., various solid state, integrated circuit and semi-conductor logic components) are mounted on a mother board 5. Data is entered into the calculator by manually depressing desired pushbutton keys 7 of a keyboard system 9 of the present invention, and the output of data from the calculator is shown on a display 11. For example, this display may be a conventional light-emitting diode (LED) module well known in the art. The power supply for the calculator is not shown.

In accordance with this invention, keyboard system 9 comprises an electrically insulative substrate board 13 of molded synthetic resin material, and a plurality of single-pole, single throw (SPST) momentary switches 15. These switches comprise a plurality of actuating elements or domed disks 17 arranged in an array of columns, as indicated at X1, X2, X3, and X4, and rows, as indicated at Y1, Y2, Y3, Y4 and Y5, on one face of board 13, and a plurality of conductors on this one face of the board. These conductors are parallel to one another and extend in the direction of the columns. There is one conductor for each column of elements, these column conductors being indicated at CX1, CX2, CX3, and CX4 for each of the respective columns X1, X2, X3 and X4. Also, there is one conductor for each row of elements, these row conductors being indicated at CY1, CY2, CY3, CY4 and CY5 for each of the respective rows Y1, Y2, Y3, Y4 and Y5. Each column conductor CX1, CX2, etc. is disposed between board 13 and its respective column of disks and is substantially aligned with the center portion of each of the disks in its column. Row conductors CY1 and CY5 are shown spaced on the outside of columns X1 and X2, respectively, and the other row conductors are located between adjacent columns.

Figure 3:
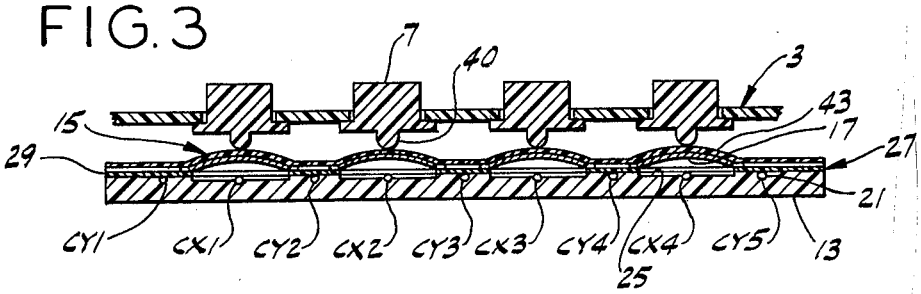
FIG. 3 is an enlarged transverse cross sectional view taken along line 3—3 of FIG. 1.
Figure 6:
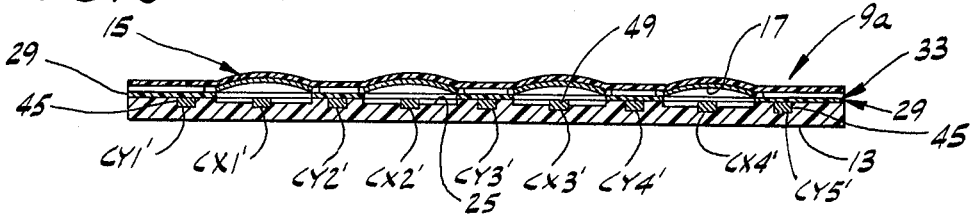
FIG. 6 is a transverse cross sectional view of the keyboard system of FIG. 5.

Each disk 17 is shown to be a concave-convex circular member of conductive material, such as a relatively thin sheet of a phosphor bronze alloy, and has an initial convex position as shown in FIGS. 3, 6 and 7. The disks are arranged with their concave faces toward board 13 and toward their respective column conductor. Each disk 17 is movable independently of the others by resiliently deforming it partially overcenter from its initial convex position (as shown in FIGS. 3, 6 and 7) in which its center portion is clear of its respective column conductor to an actuated position (see FIG. 8) in which at least one point 18 (e.g., its center portion) contacts its respective column conductor. Means, generally indicated at 19, is provided for electrically connecting each row of disks Y1, Y2, etc. to its respective row conductor CY1, CY2, etc. Thus, upon moving any one of the disks in a row to its actuating position, a circuit is completed between the respective column conductor and row conductor for the actuated disk. For example, if the disk in column X3 and in row Y4 is depressed overcenter to its actuated position, a circuit will be completed between column conductor CX3 and row conductor CY4 thereby completing a circuit unique to that disk.

Figure 2:
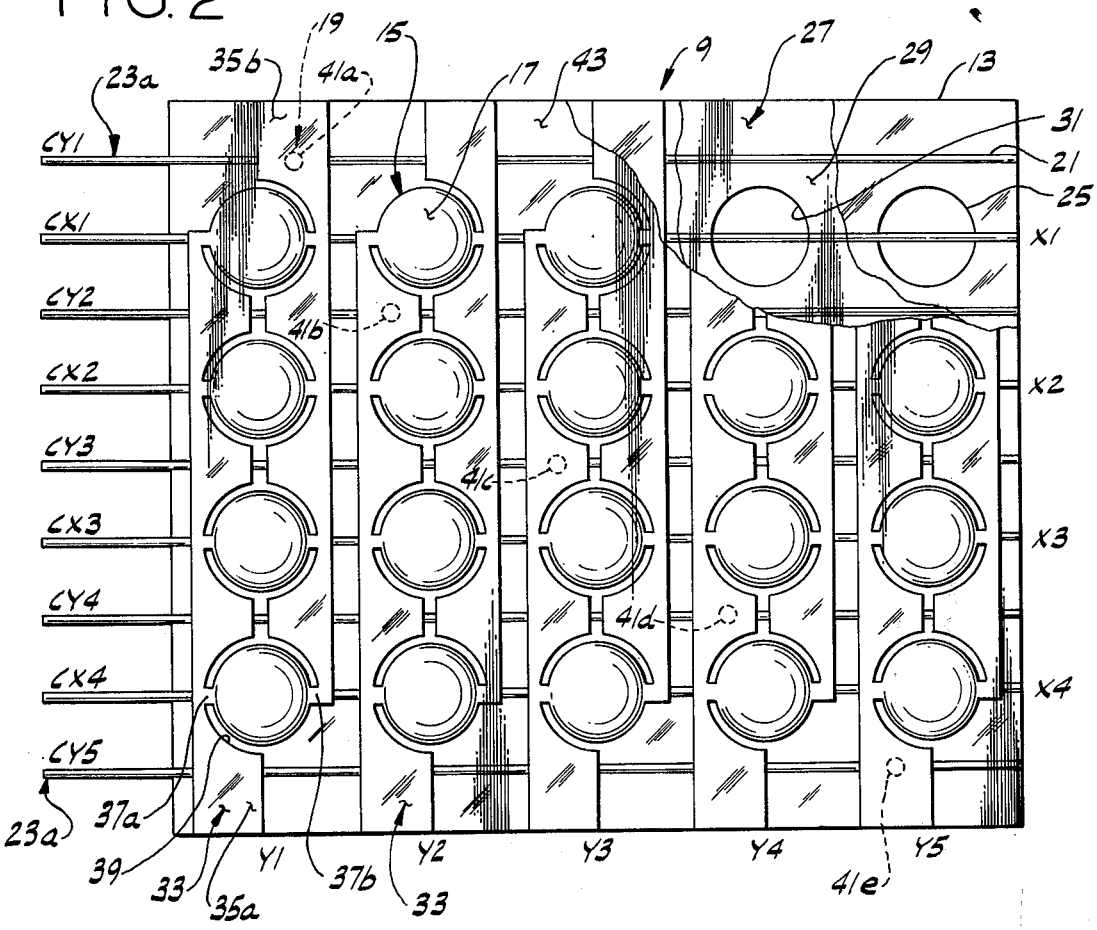
FIG. 2 is an enlarged plan view of a keyboard system of this invention with various parts broken away.
Figure 4:
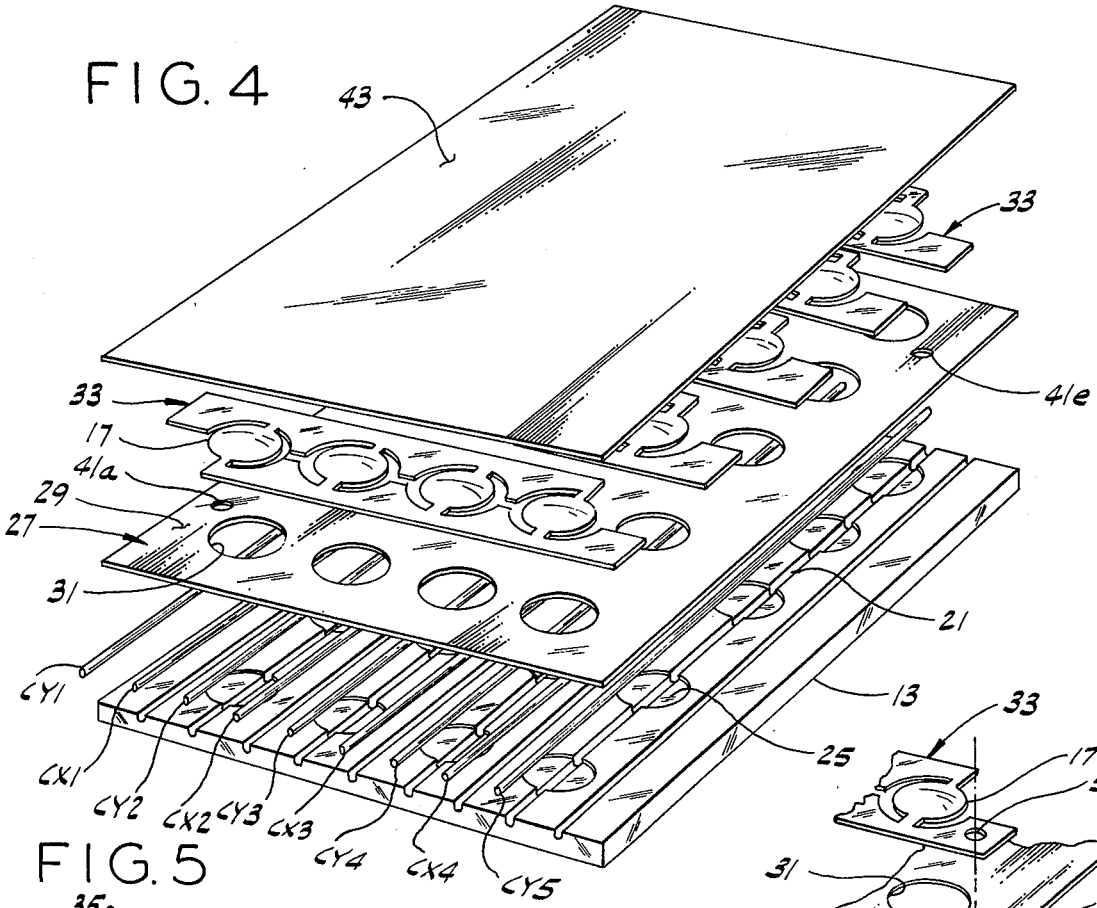
FIG. 4 is an exploded perspective view of the keyboard system illustrated in FIGS. 2 and 3.

Referring now to FIGS. 2–4, substrate board 13 is shown to comprise a molded plastic board having a series of grooves 21 formed therein extending longitudinally of the board parallel to one another for respectively receiving and securely holding conductors CX1-4 and CY1-5, each constituted by a conductive metal wire of generally circular cross section. Grooves 21 are shown to be generally semi-circular in cross section however, it will be understood that this cross sectional configuration can be employed. For instance the grooves could be rectangular in cross section with a width slightly less than the diameter of the wire so that the wire is firmly held in the groove when pressed thereon. As shown in FIG. 2, at each disk location in the board a slight circular recess 25 is provided. The upper surface of the wires extend above the bottom face of recess 25 in the substrate board 13 to permit contact by the center portions of disks 17. These recesses expose more of the wire in the area of the disk so that they may be more readily contacted by the disk as the disk is depressed overcenter to its actuated position. These recesses 25 are somewhat smaller in diameter than their respective disks 17.

As best shown in FIGS. 2 and 4, insulating means 27 is disposed between disk 17 and conductors for electrically insulating the disks from the conductors in areas where such electrical connection is not desired and for permitting the center portion of each of the disks to be flexed overcenter to contact its respective column conductor when the disk is in its actuated position. More particularly, insulating means is shown to be a sheet 29 of flexible sheet insulative material such as polyethylene terephthalate, sold under the trademark "MYLAR" by the E. I. Dupont de Nemours and Company. Sheet 29 is secured to one face of board 13, preferably by means of a thermally activated adhesive (not shown) applied to the bottom face of sheet 29 or applied to the upper face of board 13. It will be understood that other known adhesives may be used. Sheet 29 overlies the conductor wires received in grooves 21 and securely holds them in their respective grooves. The sheet has an array of circular openings 31 therethrough corresponding to the array of disks 17, there being one opening 31 for each disk. These openings are somewhat smaller than disks 17 and have a diameter generally the same as recesses 25. Thus, the outer margin of each disk 17 is supported on the upper surface of insulative sheet 29 above its respective recess 25 and is thus electrically insulated from the conductor wires. The thickness of sheet 29 and the diameter of openings 31 are such that when the disks are moved overcenter to their actuated position, the center portion of the disk contacts its respective column conductor CX1, CX2, etc. Thus, the thickness of sheet 29 constitutes means for spacing the disks from their respective column conductors.

Each row, Y1, Y2, etc. of disks 17 is shown to be a unitary metal member 33 having a plurality of disks 17 struck therefrom and a pair of metal carrier strips **35*a*, 35*b* integrally and electrically connected to each of the disks in the row by means of respective tabs 37*a*, 37*b* on opposite sides of the disk between the disks and each respective carrier strip 35*a*, 35*b*. The remainder of the periphery of each of the disks is defined by a surrounding slit 39 so that each disk is resiliently movable overcenter to its actuated position independently of the other disks in member 33. Carrier strips 35*a*, 35*b* constitute means for electrically interconnecting all the disks in a row and making all the disks in each row electrically common with one another. Sheet 29 has a series of apertures 41*a*–41*e* therein, one for each row conductor (see FIG. 2). Aperture 41*a*, for example, is in register with row conductor CY1 below carrier strip 35*b* of member 33 constituting row Y1 thereby to permit carrier strip 35*b* to be electrically connected to its respective row conductor CY1**, as by spot welding the strip to the conductor through aperture 41*a*. Apertures 41*b*–41*e* are similarly in register with their respective row conductors CY2 – CY5 and permit their respective disk row members 33 to be electrically connected to their respective row conductors. Thus, the carrier strips 35*a*, 35*b* of each of the members 33 spot welded to their respective row conductors constitute means 19 for electrically connecting each respective row of disks to its respective row conductor.

It will be understood that the row conductors of the keyboard of this invention may be arranged in a variety of positions on board 13 thereby allowing the keyboard to more readily interface with a variety of electronic logic components. As is shown in the drawings, the row conductors alternate with the column conductors. It will, however, be understood that all the row conductors could be located at the edges of the board. It will be further understood that in the arrangement shown in the drawings any row conductor may serve any desired row. For example, by spot welding member 33 of row Y1 to the row conductor indicated at CY4 rather than to conductor CY1, conductor CY4 becomes the row conductor for row Y1. Thus with only minor modification to the keyboard, the effective electrical arrangement of the conductors may be varied.

More particularly, disks 17 are generally circular in plan and of dish-shaped cross section having a double curved outer surface, such as a segment of a spheroid, and having a generally convex upper surface of curvature when they are in their initial or rest position, this convex surface being engageable by tits 40 of pushbutton keys 7. The disk has an overcenter actuated position when its center portion 18 is subjected to a preselected deflecting force and it automatically returns to its initial position upon removal of the deflecting force, whereby the element has a mechanical memory to return to its initial position. Of course, these actuating elements may have shapes other than those shown and described herein. Preferably, the disk undergoes a sudden deflection from its initial to its overcentered actuated position as it establishes electrical contact with its respective column conductor. As a result of this sudden deflection, tactile feedback is provided to the operator depressing the key which may be sensed in the fingertips. Furthermore, this sudden overcentering may provide an audible signal thus indicating the pushbutton has been properly depressed to generate the desired electrical signal.

A second sheet 43 of flexible insulative material, preferably transparent MYLAR, is adhesively applied over members 33 and sheet 29 so as to adhesively hold members 33 in position on board 13 and to seal disks 17 with respect to the board. Sheet 43 preferably has a pressure sensitive adhesive coating (not shown) on its bottom face to adhesively bond it to members 33 and to the upper face of sheet 29. As previously mentioned, sheet 43 is flexible and thus permits disks 17 to be freely depressed to their overcentered actuated positions. By sealing the disks with respect to the board, the contact surfaces of the disks and their respective column conductors are kept substantially free of dirt which may deleteriously affect the contact action between the disks and their respective conductor.

Figure 5:
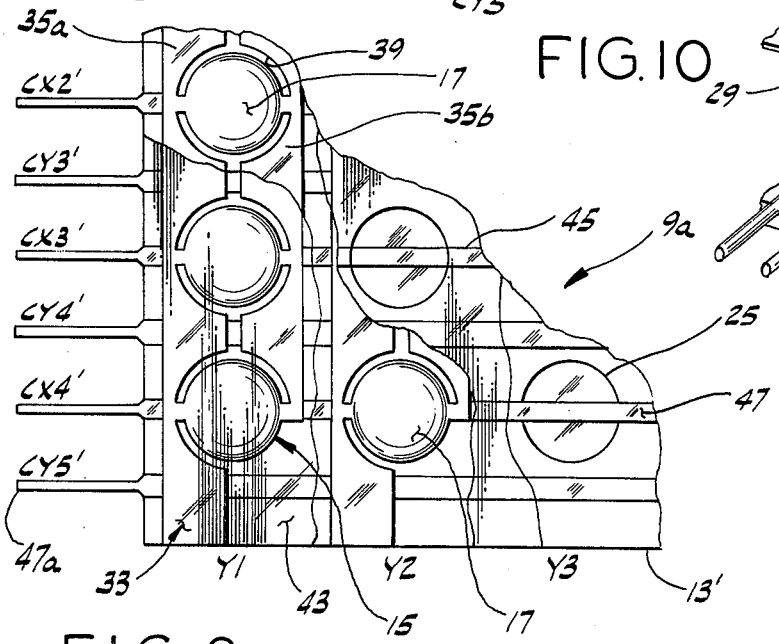
FIG. 5 is an enlarged partial plan view of another embodiment of the keyboard system of this invention.

Referring now to FIGS. 5 and 6, another embodiment of the keyboard system of this invention is indicated in its entirety at 9*a* so as to distinguish it from keyboard system 9 heretofore described. Generally, keyboard systems 9 and 9*a* are similar with corresponding reference characters indicating corresponding parts having identical functions. The main difference between keyboards 9 and 9*a* is the shape of conductors. More particularly, as shown in FIG. 6, board 13′ of keyboard system 9*a* has generally rectangular cross-section grooves 45 therein for receiving the column and row conductors, designated in this embodiment by primed reference characters, e.g., CX2′, CY3′ etc., which are conductor strips having a generally rectangular cross section and a flat upper surface 49 (see FIG. 6). This flat upper surface extends up above the bottom face of recess 25 in board 13 for being contacted by the center portion of disks 17 as the disks are moved overcenter to their actuated positions. While the round wire like conductors used in keyboard system 9 may be accommodated in grooves having either a semi-circular or rectangular cross section it is preferred to provide grooves of rectangular cross section in keyboard system 9*a* so that the flat surfaces 49 do not tend to be askew with relation to the top surface of board 13′. Similar to keyboard 9, sheet 29 of keyboard system 9*a* is adhesively bonded to the upper face of the board and holds conductor strips 47 in position in grooves 45. Operation of keyboard system 9*a* is similar to keyboard 9 and thus need not be described in detail.

In both keyboard systems 9 and 9*a* the wire or strip conductors are shown to extend beyond one end of boards 13 and 13′, as indicated at 23*a* and 47*a* in FIGS. 2 and 5, respectively. These conductor ends or extensions are bendable and constitute connector pins adapted to be inserted directly into mating connecting terminal receptacles 50 in motherboard 5 for interfacing the keyboard and the motherboard. Thus, because all the column conductors and the row conductors exit the same end edge of board 13, no additional connectors, such as unbilical wires, are needed to electrically connect the keyboard of this invention to a motherboard or to other electronic components. Specifically, conductor extensions 23*a*, 47*a* need only be inserted in their respective terminal receptacles in the motherboard and soldered in place. A further advantage of the keyboard system of this invention is that with the conductor ends 23*a*, 47*a* inserted in terminal receptacles at one end of the motherboard and with conductor ends 51 of display 11 inserted into corresponding terminal receptacles 50 at the other end of the motherboard, the conductor leads for both the keyboard and the display can be simultaneously soldered to the motherboard in conventional wave soldering apparatus. After soldering, the conductor ends 23*a* or 47*a* may be bent so that the keyboard system 9 or 9*a* overlies motherboard 5 in position, as shown in FIG. 1, for actuation by keys 7.

Since both the wire and strip conductors are readily received in their respective grooves 21 and 45 in substrate boards 13 and 13*a*, and since these conductors are adhesively held in place on the board by insulative sheet 29, the requirement of a printed circuit board is eliminated. Also, since no soldering is needed in the keyboard system of this invention, the substrate board 13 or 13′ may be molded of an inexpensive, relatively low melting temperature thermoplastic resin, such as acrylonitrile-butadiene-styrene (ABS) or the like. Furthermore, since the substrate board is not visible when incorporated in a calculator, the board may be molded of scrap plastic of a variety of colors.

Figure 10:
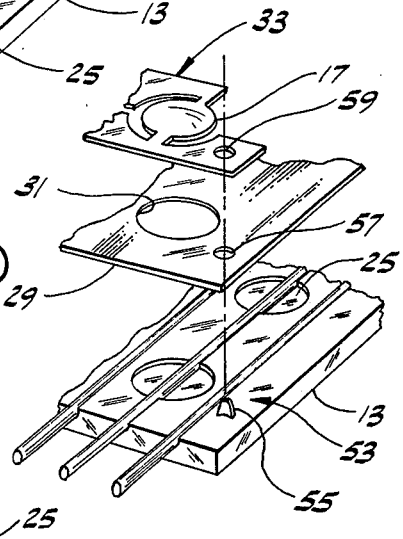
FIG. 10 is an exploded partial perspective view of a portion of the keyboard system of this invention illustrating an alternative manner for aligning and for securing various parts of the keyboard together.

As shown in FIG. 10, sheet 29 and disk members 33 may optionally be aligned relative to recesses 25 in board 13 and secured in place by means as generally indicated at 53. More particularly, means 53 are shown to comprise a plurality of locating lugs 55 molded in the upper face of board 13 and extending or projecting upwardly therefrom and generally perpendicularly thereto. Lugs 55 are generally arcuate in cross section and are insertable through locating holes or apertures 57 in insulative sheet 29 and through apertures 59 in carrier strips 35*a*, 35*b* of disk members 33 thereby to locate the openings 31 in sheet 29 and disks 17 in members 33 in proper position with respect to recesses 25 in board 13. The lugs may be somewhat tapered so as to have a tight fit within apertures 59. Thus, by means of a press connection between lugs 55 and the apertures 59 members 33 are positively secured in place on board 13.

It will be understood that each column conductor may be constituted by a spaced parallel pair of wires or strips aligned below each column of disks so as to be simultaneously contacted by a disk as that disk is moved to its overcenter actuated position.

In view of the above, it will be seen that the several objects of the invention are achieved and other advantageous results attained.

As various changes could be made to the above constructions without departing from the scope of the invention, it is intended that all matter contained in the above description or shown in the accompanying drawings shall be interpreted as illustrative and not in a limiting sense.

What is claimed is:

1. A pushbutton keyboard system comprising an electrically insulative substrate, a plurality of actuating elements arranged in an array of columns and rows on one face of said substrate, a plurality of conductors on said one face of said substrate, said conductors being parallel to one another and extending in the common direction of said columns to terminate adjacent a common edge of said substrate, there being one conductor for each row of elements constituting a row conductor and another conductor for each column of elements constituting a column conductor, each column conductor extending along the substrate between the substrate and the elements of its respective column and said row conductors extending along the substrate with at least some of the row conductors disposed between said column conductors in spaced relation to adjacent column conductors, each of said elements being of a flexible electrically conductive material and having an initial position in which it is clear of its respective column conductor, each of said elements being resiliently deformable from its initial position to an actuated position in which at least one point on the element is in contact with its respective column conductor, and means for electrically connecting the elements in each said row to their respective common row conductor whereby, upon moving any one of said actuating elements in any row to its actuated position, a circuit is completed extending from said common substrate edge through the column conductor of said element and the row conductor of said row of actuated elements back to said common substrate edge.

2. A keyboard system as set forth in claim 1 wherein extensions of said respective conductors extend beyond said common edge of the substrate for permitting electrical connection to electronic components outside the system.

3. A keyboard system as set forth in claim 1 wherein said actuating elements are concave-convex disks with their concave faces toward their respective column conductors.

4. A keyboard system as set forth in claim 3 wherein said means for electrically connecting the elements in each row comprises at least one strip of metal secured to each disk in said row in electrical contact therewith and permitting each of said disks to be flexed independently of one another between its initial and its actuated positions, said strip being electrically connected to a respective row conductor.

5. A keyboard system as set forth in claim 4 wherein said electrical connecting means comprises a pair of said strips, one on opposite sides of said disks of said row, extending substantially parallel to said row of disks, each said strip being integrally connected to each said disk in said row at one location and being free of the disks elsewhere around the periphery of the disks.

6. A keyboard system as set forth in claim 1 further comprising insulating means between said elements and said row and column conductors for electrically insulating each said element from its respective column conductor when the elements are in their initial position and for permitting said one point on each of said elements to contact its respective column conductor when the element is moved from its initial to its actuated position, said insulating means having openings permitting electrical connection of rows of said elements to respective row conductors.

7. A keyboard system as set forth in claim 6 wherein said insulating means is a sheet of insulating material secured to said one face of said substrate with said conductors therebelow, said sheet having an array of openings therein corresponding to said array of elements, there being one opening for each element, said openings being somewhat smaller than said elements so as to electrically insulate the outer margins of said elements from their respective column conductor and to permit said one point on each of said elements to contact its respective column conductor when it is moved from its initial to its actuated position.

8. A keyboard system as set forth in claim 7 wherein said sheet is adhesively secured to said one surface of said substrate.

9. A keyboard system as set forth in claim 8 wherein said sheet has a heat-activated adhesive on one face thereof for adhesively securing said sheet to said substrate.

10. A keyboard system as set forth in claim 7 wherein said sheet has other openings therein, one for each said row conductor, said other openings being in register with respective row conductors for electrically connecting each said row of actuating elements thereto.

11. A keyboard system as set forth in claim 1 further comprising a sheet of flexible electrical insulative material overlying said actuating elements and said electrical connecting means.

12. A keyboard system as set forth in claim 11 wherein said sheet of insulative material has an adhesive on one face thereof, said adhesive gripping said elements and said substrate for holding said elements in said array on said one face of said substrate and for sealing the elements relative to the substrate thereby to substantially prevent contamination of the electrical contact between each said element and its respective conductor.

13. A keyboard system comprising an electrically insulative substrate board of a molded synthetic resin material having a plurality of parallel grooves in one surface thereof extending in one direction of the board, a plurality of actuating elements arranged in an array of columns and rows on said one face of the board with said columns extending substantially in said one direction, a plurality of conductors received by said grooves, one conductor in each groove, there being one conductor for each row of said elements constituting a row conductor and one for each column of said elements constituting a column conductor, each of said column conductors being substantially aligned with the center portion of each of the elements in that column, each of said elements comprising a concave-convex disk of flexible electrically conductive material, each said row of elements comprising a series of said disks in line with one another and electrically connected to an electrically conductive carrier on each side of the line of disks, each said line of disks and said carriers secured thereto constituting a unitary strip, each disk in said strip having its concave face toward said board and being movable independently of one another from an initial convex position in which the center portion of the disk is clear of its respective column conductor to a partially over-center actuated position in which the center portion of the disk is in electrical contact with its respective column conductor, said carriers being electrically common to all of said disks in its respective strip, one of said carriers of each said strip being electrically connected to a respective row conductor, a plurality of recesses in said board arranged in an array corresponding to said array of actuating elements, there being one disk for each recess, a first insulative sheet interposed between said board and said strips for electrically insulating said strips and said disks from said conductors, said sheet being secured to said board and having an array of openings therein corresponding to said array of elements, said openings being smaller than said disks so that the outer periphery of the disks are engageable with said sheet, said center portions of the disks being received by said openings thereby to enable the disks to make contact with their respective conductors as they are moved from their initial positions into their actuated positions, and a second sheet of flexible insulative material overlying said strips, said second sheet being adhesively secured to the outer face of said strips and to said first sheet for electrically insulating the strips and for sealing the disks relative to the board thereby to substantially prevent contamination of the electrical contact between said disks and their respective column conductors.

14. A keyboard as set forth in claim 13 wherein each of said conductors is an elongate strip having a flat upper surface, each strip being received within a respective groove, with the flat exposed outer surfaces of said strips constituting said column conductors being engageable by the center portions of said disks constituting a column as the disks are moved to their over-center actuated positions.

15. A keyboard as set forth in claim 13 further comprising means for aligning said openings in said first insulative sheet and said disks in said strips relative to said recesses in said board, this last-said means comprising a plurality of locating lugs projecting from said one face of said board generally perpendicular thereto and a plurality of apertures in said first insulative sheet and a plurality of apertures in each said strip whereby with the lugs received in their corresponding apertures in said first sheet and in said strips, said openings in said first sheet and said disks are in their desired positions with respect to said recesses.

16. An actuating device for use in selectively closing a plurality of electrical circuits with snap action comprising an electrically conductive metal member having carrier strip means with one surface thereof extending in a plane, said carrier strip means being integral with and having respective portions thereof electrically connecting the carrier strip means with a plurality of domed, concave-convex dished portions of the member which are arranged in a row, each of the dished portions having the margin of said dished portion commonly disposed in said plane and extending up from said plane and having major parts of the periphery of each said dished portion separated from said carrier means for permitting said dished portions to be moved individually and with snap action from an original dished configuration to an inverted dished configuration in response to the application of force to said dished portion.

17. An actuating device as set forth in claim 16 wherein each of said dished portions is concave-convex in section and circular in plan view and has the configuration of a segment of a spheriod and wherein said integral carrier means comprises a strip portion of said member extending laterally along each side of a plurality of said dished member portions integrally connected to each of said dished portions at said lateral side thereof.

* * * * *